US006446273B1

(12) United States Patent
Gillen et al.

(10) Patent No.: US 6,446,273 B1
(45) **Date of Patent: *Sep. 10, 2002**

(54) PROTECTIVE BODY VEST

(76) Inventors: Sherry S. Gillen; James B. Gillen, 444 W. Witchwood La., both of Lake Bluff, IL (US) 60044

( * ) Notice: Subject to any disclaimer, the term of this patent is extended or adjusted under 35 U.S.C. 154(b) by 0 days.

This patent is subject to a terminal disclaimer.

(21) Appl. No.: 10/000,246

(22) Filed: Oct. 29, 2001

(51) Int. Cl.[7] ..... A62B 17/00; F41H 1/00

(52) U.S. Cl. ..... 2/455; 2/456; 2/459; 2/463; 2/464; 2/465; 2/467; 2/2.5

(58) Field of Search ..... 2/455, 456, 459, 2/463, 464, 465, 467, 2.5

(56) References Cited

U.S. PATENT DOCUMENTS 4,100,620 A * 7/1978 Pecoraro ..... 2/102
4,441,211 A * 4/1984 Donzis ..... 2/459
4,847,913 A * 7/1989 Chen ..... 2/2.5
4,884,295 A * 12/1989 Cox ..... 2/2.5
5,465,423 A * 11/1995 Taylor-Varney ..... 2/44
5,546,602 A * 8/1996 Hale ..... 128/874
5,652,967 A * 8/1997 Hsu ..... 2/455
6,138,277 A * 10/2000 Gillen et al. ..... 2/102
6,185,738 B1 * 2/2001 Sidebottom ..... 2/102

* cited by examiner

*Primary Examiner*—John J. Calvert
*Assistant Examiner*—Robert H. Muromoto, Jr.
(74) *Attorney, Agent, or Firm*—Meroni & Meroni, P.C.; Charles F. Meroni, Jr.; Christopher J. Scott

(57) ABSTRACT

A protective body vest for protecting against impact upon torso when worn by an athlete during sporting activities. The invention comprises a multi-section, one-piece garment comprising of a vest sized and shaped to be worn on the torso of an athlete with a multi-layered protective padding that automatically adjusts for varying body sizes and can be customized by the wearer based on safety, comfort and athletic performance concerns. The invention further comprises a shoulder portion with oversized apertures for the arms, an anterior portion, a pair of lateral portions and a tapered-design posterior portion. The invention further utilizes an offset opening located off set from the medial line of a human torso to protect the heart and a flap or overlap to protect the region of the offset opening and cover the vest area about the offset opening.

113 Claims, 4 Drawing Sheets

PROTECTIVE BODY VEST

BACKGROUND OF THE INVENTION

1. Field of the Invention

The present invention relates to protective body vests for protecting against impact upon a human torso when worn by an athlete during sporting activities. More specifically, the present invention is primarily intended to provide a baseball/softball player added protection from injuries resulting from being hit by a pitched, thrown, hit or tipped ball, being tagged with a ball or colliding with another player. The present invention can also be utilized by athletes engaged in other sporting activities, such as, but not limited to, inline skating, skateboarding and touch football, to provide added protection from injuries resulting from falling to the ground or colliding with another person or player.

2. Description of the Prior Art

In recent years, many vests have been created for the purpose of providing protection to the torso of an athlete engaged in sporting activities. These vests, however, only afforded protection to limited areas of the body. In particular, U.S. Pat. No. 5,669,080, issued to Culton, discloses a protective apparatus against baseball pitching injuries, which is essentially a partial vest contoured to protect the chest, shoulders, and upper arms of the athlete. Designed primarily for use by baseball/softball umpires, the Protective Apparatus is not conducive to batting, running, throwing, fielding or sliding motions due to the combination of adjustable flexible and non-flexible arm and shoulder straps which secure the apparatus snugly to the arms, shoulders and neck of the wearer, prohibiting the full and easy movement of the arms and neck of an athlete wearing the apparatus, and the protective covering over the upper arms which the apparatus provides. In addition, the degree of protection afforded by the Protective Apparatus from a pitched, hit, thrown or tipped ball a fall, or a collision is limited since 1) there is no protection for the lateral regions and the back of the torso and 2) the amount of protective material in the apparatus is limited since it is designed to fit under the shirt of an umpire. Designed primarily for use by baseball/softball umpires who would wear the apparatus for an extended period of time (i.e., the duration of a baseball/softball game), the Protective Apparatus is not quickly and easily donned due to the number, location and operation (i.e., any required adjustment for fit) of the securing straps and the fact that the wearer has to put on the vest over his/her head while placing one arm at a time through the arm straps. In particular, to achieve the proper fit of the shoulder strap, the wearer would have to reach around his/her lower back with both hands for the most effective operation of the adjusting mechanism, which is located behind the wearer, unless he/she solicited the help of another person.

Moreover, U.S. Pat. No. 4,668,202, issued to Scheurer et al., and U.S. Pat. No. 5,328,398, issued to Aubrey, both disclose protective vests for flotation utilized in water sporting activities. These vests both have a reduced overall flexibility for other sporting activities due to the relative rigidity of the vest materials. Further, both of these water vests utilize an exposed center opening for the user to put on the vest, a deep V-neck design and a plurality of securing belts fastened across the center opening. These water vests are primarily designed for flotation purposes and not for protection against impact from sporting activities. As such, these vests do not provide the necessary protection needed for the whole torso. Though the water vests provide some protection against the impact of the water, the combination of the center opening and deep V-neck design exposes the heart of the athlete to impact. Further, the body area below the center opening is unprotected, as the center opening is not covered by protective material. Additionally, the securing belts fastened across the center opening are uncovered, resulting in a possible "catch." Finally, the back of these water vests does not protect the lower spine area of the body from impact forces. In particular, U.S. Pat. No. 4,668,202 contains a rear opening to adjust the vest to the particular body size that leaves the back exposed to impact forces.

It is therefore highly advantageous to provide a protective vest that can provide protection from a multi-section, one-piece garment to the whole torso. It is also highly advantageous for safety and health concerns to provide a protective vest that automatically adjusts the protective material to provide protection to the whole torso for varying body sizes. In addition, it is advantageous to provide a protective vest that allows for the removal and insertion of the protective padding relative to the wearer's safety, comfort and athletic performance concerns. Additionally, it is advantageous to provide a protective vest that is quickly and easily donned and removed, thus encouraging its use and providing a significant degree of protection to the wearer. Further, it is advantageous to provide a protective vest with an opening off set from the medial line of a human torso to protect against impact to the heart during sporting activities. Still further, it is advantageous for safety reasons to provide a flap or overlap made of protective material to protect the region of the offset opening and cover the area of the vest about the offset opening. Still further yet, it is advantageous to provide a protective vest with a tapered design in the inferior-most region of the posterior portion to protect the lower spine area of the boy from impact, yet permit unhindered movement of the legs. Finally, it is advantageous to provide a protective vest that permits unhindered movement of the arms and neck of the athlete wearing the vest. The present invention provides these and other advantages as is hereinafter explained.

Accordingly, it is a principal object of our invention to provide a multi-section, one-piece garment with multi-layered protective padding encasing the whole human torso that automatically adjusts the multi-layered protective padding for varying body sizes, allows for removal and insertion of the protective padding for safety, comfort and athletic performance concerns, has a tapered design in the inferior-most region of the posterior portion, an offset opening and a flap or overlap for health and safety purposes.

It is a further object of our invention to provide a multi-section, one-piece garment with multi-layered protective padding encasing the whole human torso that automatically adjusts the multi-layered protective padding for varying body sizes, allows for removal and insertion of the protective padding for safety, comfort and athletic performance concerns, has a tapered design in the inferior-most region of the posterior portion and has an offset opening for health and safety purposes.

It is a still further object of our invention to provide a multi-section, one-piece garment with multi-layered protective padding encasing the anterior, shoulder and lateral regions of the human torso that has an offset opening and a posterior portion that allows for the cooling of the underlying torso for health and safety purposes.

U.S. Pat. No. 6,138,277, issued to Gillen et al., discloses a Protective Body Vest. The subject matter of this specification represents inventive subject matter originating from the same inventive entity as that of U.S. Pat. No. 6,138,277.

Further, the subject matter of this specification details significant improvements over that subject mate found in U.S. Pat. No. 6,138,277.

SUMMARY OF THE INVENTION

According to our present invention we have provided a multi-section, one-piece garment for protecting against impact upon a human torso when worn by an athlete during sporting activities comprising a vest sized and shaped to be worn on the torso of an athlete having a multi-layered padding to protect the torso of the athlete. The vest is composed generally of a shoulder portion, an anterior portion, a pair of lateral portions, a posterior portion and an offset opening. The multi-layered padding has a first, or outer layer, a second, or middle layer and a third, or inner layer, wherein the first and the third layers sandwich, or are joined at a seam to provide a shell for, the second layer, the second layer being formed from a padding material for protecting the torso against impact.

The multi-layered padding in the shoulder portion is sized, shaped and constructed to provide protection against impact to the shoulder area and unhindered movement of the arms and neck. The shoulder portion further has the multi-layered padding being 1/64 inch to 1½ inch thick. The shoulder portion further has a pair of oversized apertures located at the lateral most regions for receiving the arms, each oversized aperture being sized and shaped to permit full movement of the arm.

The anterior portion of the vest has the multi-layered padding sized and shaped to provide protection against impact to the abdomen, heart, spleen, and chest areas and allow unhindered movement of the legs. The anterior portion of the vest further has the multi-layered padding being 1/64 inch to 1½ inch thick. The anterior portion further has the first and third layers of the multi-layered padding being formed from an air-permeable, moisture-wicking material to allow for the cooling of the underlying torso.

The offset opening is located offset from the medial line of a human torso to protect the heart against impact.

The pair of lateral portions of the vest are located inferior to the pair of oversized apertures wherein each lateral portion has the multi-layered padding sized, shaped and constructed to provide protection against impact to the lateral regions and unhindered movement of the legs. The pair of lateral portions of the vest further has the multi-layered padding being 1/64 inch to 1½ inch thick.

The posterior portion of the vest has the multi-layered padding sized and shaped to provide protection to the back and unhindered movement of the legs. The posterior portion of the vest further has the multi-layered padding being 1/64 inch to 1½ inch thick. The posterior portion further has the first and third layers of the multi-layered padding being formed from an air-permeable, moisture-wicking material to allow for the cooling of the underlying torso. The posterior portion may further comprise at least one holder or fastener for securing a removable strip of fabric or flag, such as a "flag football" flag. The posterior portion may further be shaped in a tapered design at the inferior-most region to allow the unhindered movement of the legs and to provide protection for the lower spine area.

The present invention further comprises at least one slot or opening on the interior or exterior surface or the first or third layer of the multi-layered padding allowing for removal or insertion of the second, or middle layer of the multi-layered padding, or a layer or layers, or a portion or portions, or a section or sections thereof, from the vest.

The present invention further comprises an overlap or flap that extends or is located over the offset opening and sized and shaped to protect the region of the offset opening against impact and cover the area of the vest about the offset opening. The overlap or flap has the multi-layered padding 1/64 inch to 1 inch thick. The overlap or flap extends from or is attached to the vest and fastened across the offset opening by a fastening device or devices. The flap may further contain at least one fastener attached on its exterior surface and correspondingly on the exposed exterior surface to secure the flap in an open position on the vest in order to facilitate the donning of the vest.

The present invention further comprises a fastening device or devices to engage the vest when fastened to secure the vest about the torso.

The lateral most edges of the second layer of the multi-layered padding in the anterior portion and/or posterior portion of the vest, or a layer thereof, extend over and/or overlap in the pair of lateral portions of the vest in order to maintain a second layer of the multi-layered padding between the first and third layers in the pair of lateral portions of the vest as the vest stretches horizontally to accommodate larger torso sizes.

The present invention may further have the second, or middle layer of the multi-layered padding being formed from polymeric cellular foam material for protecting against impact to the torso. The present invention may further have the first and/or second and/or third layers of the multi-layered padding, or a portion or portions, or a section or sections thereof, being comprised of multiple layers. The present invention may further have the multi-layered padding, or a layer or layers, or a portion or portions, or a section or sections thereof, being punctuated with a plurality of air holes to provide for the cooling of the underlying torso.

The present invention may further comprise at least one adjustable securing belt-like device such as a belt, strap or drawstring wrapped around the multi-layered padding, or partially thereof, on the first, or outer layer, the second, or middle layer, or a layer thereof, or the first and second layer alternately, of the vest to secure the vest about the torso, the adjustable securing belt-like device being inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

The present invention may further have a protective pad or pads comprising rigid, semi-rigid or flexible material are affixed onto, and/or inserted into a pocket on, the interior and/or exterior surface of the first, or outer layer of the multi-layer padding, and/or the interior and/or exterior surface of the second, or middle layer of the multi-layered padding, or a layer thereof, and/or the interior and/or exterior surface of the third, or inner layer of the multi-layered padding of the second anterior side of the anterior portion and sized and shaped to provide protection from impact to the heart and/or spleen.

According to our present invention, we have provided a multi-section, one-piece garment for protecting against impact upon a human torso when worn by an athlete during sporting activities comprising a vest sized and shaped to be worn on a torso of an athlete having a multi-layered padding to protect the torso of the athlete. The vest further comprises a shoulder portion, an anterior portion, a pair of lateral portions, a posterior portion and an offset opening.

The multi-layered padding has a first, or outer layer, a second, or middle layer and a third, or inner layer wherein the first and the third layers sandwich, or are joined at a seam to provide a shell for, the second layer, the second layer being formed from a padding material.

The offset opening is off set from the medial line of a human torso to protect the heart against impact.

The present invention further comprises an overlap or flap that extends or is located over the offset opening and sized and shaped to protect the region of the offset opening against impact and cover the area of the vest about the offset opening. The overlap or flap extends from or is attached to the vest and fastened across the offset opening by a fastening device or devices to secure the vest on the torso.

In the shoulder portion the multi-layered padding is sized and shaped to protect the shoulder area and permit unhindered movement of the arms and neck. The shoulder portion further has a pair of oversized aperture located at the lateral most regions for receiving the arms, each oversized aperture being sized and shaped to permit fill movement of the arm.

The anterior portion is sized and shaped to provide protection to the chest, heart, spleen and abdomen regions and allow unhindered movement of the legs.

The pair of lateral portions, located inferior to the pair of oversized aperture are sized and shaped to provide protection to the lateral regions of the torso and allow unhindered movement of the legs.

In the posterior portion the multi-layered padding is sized and shaped to provide protection against impact to the back and unhindered movement of the legs.

In another embodiment which, save for the omission of the flap or overlap is virtually identical to the preferred embodiment, we have provided a multi-section, one-piece garment for protecting against impact upon a human torso when worn by an athlete during sporting activities comprising a vest sized and shaped to be worn on a torso of an athlete having multi-layered padding to protect the torso of the athlete. The vest further comprises a shoulder portion, an anterior portion, a pair of lateral portions, a posterior portion and an offset opening. The multi-layered padding has a first, or outer layer, a second, or middle layer and a third, or inner layer wherein the first and the third layers sandwich, or are joined at a seam to provide a shell for, the second layer, the second layer being formed from a padding material.

The shoulder portion has a pair of oversized apertures located at the lateral most regions for receiving the arms, each oversized aperture being sized and shaped to permit full movement of the arm.

The offset opening is off set from the medial line of a human torso to protect the heart against impact.

The present invention further comprises a fastening device to engage the vest when fastened to secure the vest about the torso.

The posterior portion of the vest may further be shaped in a tapered design at the inferior-most region to allow unhindered movement of the legs and provide protection to the lower spine area.

The posterior portion may further have a strap fastener in the interior-most region therein to connect to a strap fastener on the inferior-most region of the anterior portion of the vest by a strap, therein to engage the posterior portion of the vest to the anterior portion to achieve a more secure, more contoured fit.

In another embodiment of the vest which, in its two forms—with and without the flap or overlap—is virtually identical to each of the earlier embodiments save for the omission of protective padding from the posterior portion, we have provided a multi-section, one-piece garment for protecting against impact upon a human torso when worn by an athlete during sporting activities comprising a vest sized and shaped to be worn on a torso of an athlete including an anterior portion, a posterior portion, a pair of lateral portions, a shoulder portion and an offset opening, the vest having a multi-layered padding in the anterior portion, the shoulder portion and the pair of lateral portions, the posterior portion of the vest being comprised of material that allows for the cooling of the underlying torso. The multi-layered padding has a first, or outer layer, a second, or middle layer and a third, or inner layer wherein the first layer and the third layer sandwich, or are joined at a seam to provide a shell for, the second layer, the second layer being formed from a padding material.

The offset opening is off set from the medial line of a human torso to protect the heart against impact.

The present invention further comprises a fastening device or devices to engage the vest when fastened to secure the vest about the torso.

The present invention may further comprise an overlap or flap that extends or is located over the offset opening and sized and shaped to protect the region of the offset opening against impact and cover the area of the vest about the offset opening. The overlap or flap extends from or is attached to the vest and fastened across the offset opening by a fastening device or devices to secure the vest on the torso.

Each of the embodiments of the invention described above can, with the following slight modifications, be worn by a mature female athlete: incorporating a convex configuration in the superior region of the anterior portion, and in the superior region of the flap or overlap for those embodiments that include the flap or overlap, for receiving the female breasts and incorporating a concave configuration in the inferior-most regions of the pair of lateral portions for receiving the female hips.

Other objects of our invention, as well as particular features, elements, and advantages thereof will be elucidated in, or apparent from, the following description and the accompanying drawing figures.

DESCRIPTION OF THE DRAWINGS

Other features of my invention will become more evident from a consideration of the detailed description of my patent drawings, as follows:

FIG. 2 further shows the fastening device being attached about the offset opening and covered by the flap.

DETAILED DESCRIPTION

Figure 1:
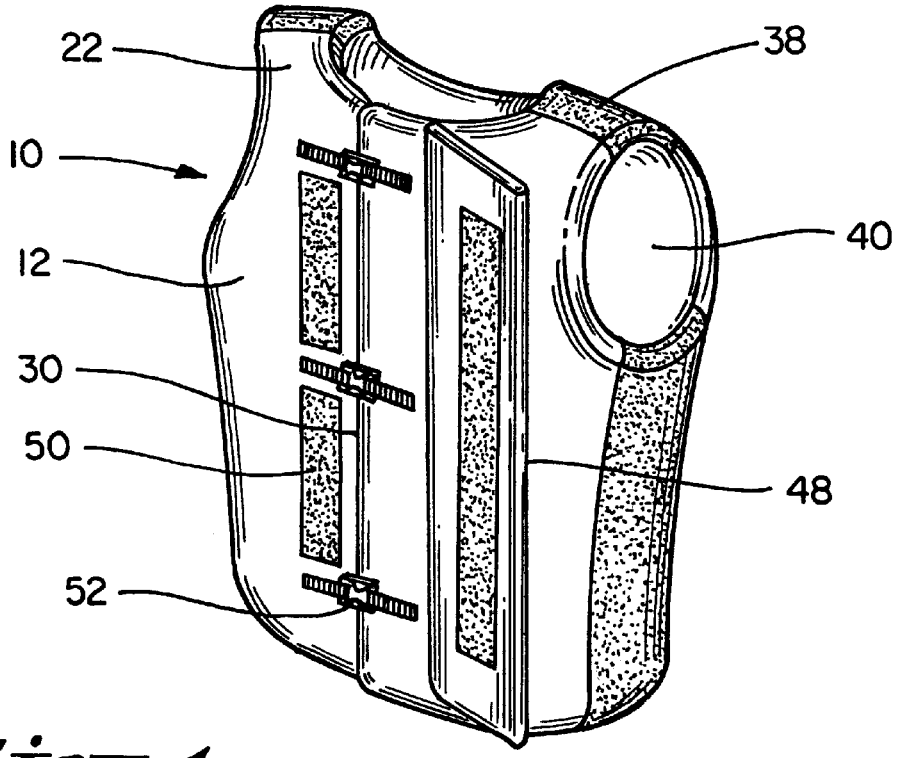
FIG. 1 is a perspective view of the present invention showing the offset opening a fastening device and the flap in an open position.

Referring now to the drawings, our preferred embodiment of the present invention comprises a multi-section, one-piece garment 10 for protecting against impact upon a human torso when worn by an athlete during sporting activities, the multi-section, one-piece garment 10 comprising a vest 12 sized and shaped to be worn on a torso of an athlete having a multi-layered padding 14 to protect the torso of the athlete, including a chest, an abdomen, a pair of sides, a shoulder area and a back. Key features of our invention, as shown in FIGS. 1, 2, 3, 4, 5 and 9, are the multi-section, one-piece garment 10 utilizing an offset opening 30 in an anterior portion 24, a flap 48 over the offset opening 30, a multi-layered padding 14, a slot or opening 72 allowing for the removal and/or insertion of a second, or middle layer 18 of the multi-layered padding 14, a tapered design 62 in the inferior-most region of the posterior portion 28 and an overlapping 74 of the second, or middle layer 18 of the multi-layered padding 14 from the anterior portion 24 and/or the posterior portion 28 in a pair of lateral portions 26. The multi-section, one-piece garment 10 comprises of a vest 12 sized and shaped to be worn on a torso by an athlete having a multi-layered padding 14, a shoulder portion 22, an anterior portion 24, a pair of lateral portions 26, a posterior portion 28, an offset opening 30, a flap 48 over the offset opening 30, a tapered design 62 in the inferior-most region of the posterior portion 28, a slot or opening 72 allowing for the removal and/or insertion of a second, or middle layer 18 of the multi-layered padding 14 and an overlapping 74 of the second, or middle layer 18 of the multi-layered padding 14 from the anterior portion 24 and/or the posterior portion 28 in the pair of lateral portions 26 as shown in FIGS. 1, 2, 3, 4, 5 and 9.

Figure 5:
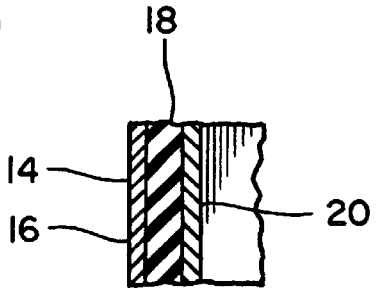
FIG. 5 is a cross-sectional view of the multi-layered padding of the present invention showing the first, or outer layer, the second, or middle layer, and the third, or inner layer.

As shown in FIG. 5, the multi-layered padding 14 contains a first, or outer layer 16, a second, or middle layer 18 and a third, or inner layer 20. The first layer 16 and the third layer 20 of the multi-layered padding 14 sandwich, or are joined at a seam to provide a shell for, the second, or middle layer 18. As is common practice, a welting may be inserted in the seam where the first layer 16 and third layer 20 are joined to form the shell. The second layer 18 is formed from a padding material to protect the torso against impact from sporting activities. Excellent results are obtained when the second layer 18 of the multi-layered padding 14 is made from polymeric cellular foam similar in texture, sponginess, flexibility, pliability, resiliency and strength resilience to Polyethylene or Polyvinyl Chloride. Further excellent results are obtained using other polymeric cellular compounds, either individually or in a composite, including Vinyl Nitrile, Styrene-Butadiene, Neoprene, Ethylene, Propylene, Terpolymer, Nitrile, Epiclorohydrin, Ethylene Acetate and Chlorinated Polyethylene.

In order for an athlete, particularly a baseball or softball player, to hit, throw or catch a ball, run, slide, or otherwise perform effectively, unhindered movement of the arms and neck is necessary. Accordingly, as shown in FIGS. 1, 2, 3 and 4, the multi-layered padding 14 in the shoulder portion 22 is sized, shaped and constructed to allow unhindered movement of the arms and neck in addition to providing protection to the shoulder area and flexibility to accommodate varying torso sizes. Excellent results are obtained when the multi-layered padding 14 in the shoulder portion 22 is 1/64 inch to 1½ inch thick and comprised of elastic fabric-covered Neoprene padding 38.

Figure 4:
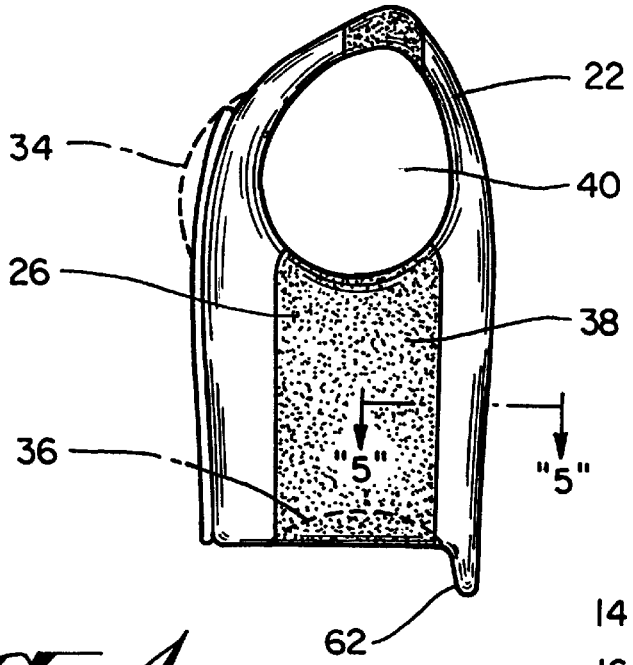
FIG. 4 is a side view of the present invention showing the oversized arm apertures and the convex and concave configurations of the female versions of the vests.

The shoulder portion 22 further contains a pair of oversized apertures 40, as shown in FIGS. 1 and 4, leaving the shoulder area in an unhindered condition and allowing full movement of the arms.

Figure 2:
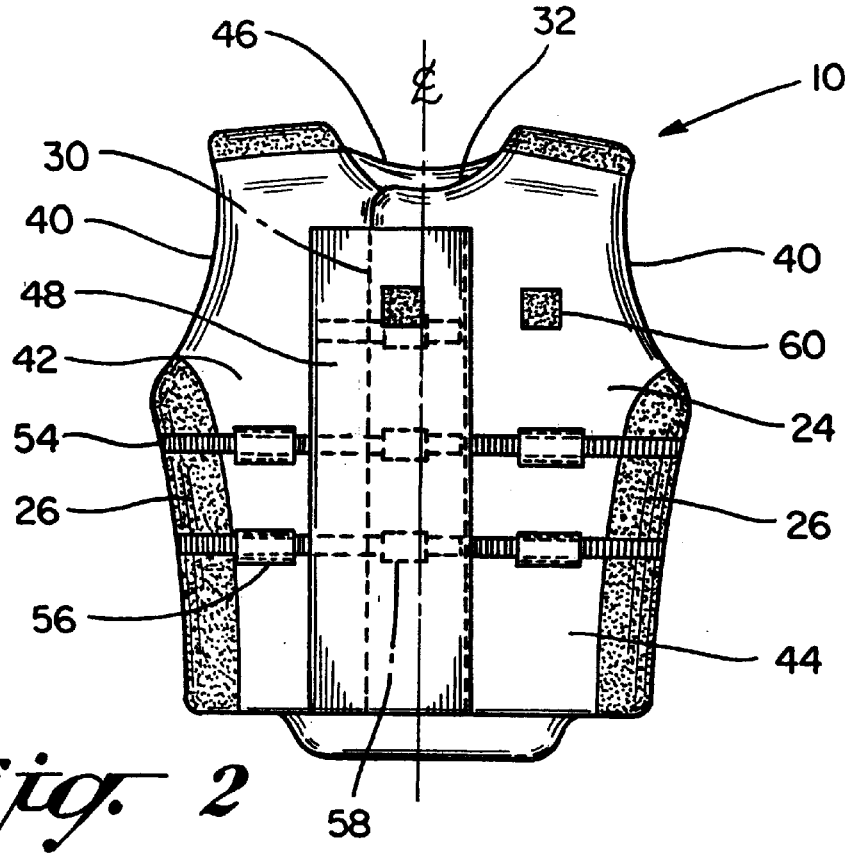
FIG. 2 is a front view of the present invention showing the flap in a closed position over the region of the offset opening.

The anterior portion 24 has the multi-layered padding 14 sized and shaped to provide protection against impact to the chest, heart, spleen and abdomen and allow unhindered movement of the legs. Excellent results are obtained when the multi-layered padding 14 in the anterior portion 24 is 1/64 inch to 1½ inch thick. The anterior portion 24 further has the first layer 16 and the third layer 20 of the multi-layered padding 14 being formed from an air-permeable, moisture-wicking material to allow for the cooling of the underlying torso. Excellent results are obtained when the material in the first layer 16 and the third layer 20 of the multi-layered padding 14 is made from a fabric similar in texture, durability, air permeability and moisture-wicking capability to CORDURA Nylon or COOLMAX An important feature of the preferred embodiment of our invention is an offset opening 30 as shown in FIGS. 1 and 2. Most protective vests contain an opening located in the front center. Increased safety is obtained when the vest 12 has an offset opening 30. In the preferred embodiment, the offset opening 30 is located offset from the medial line of a human torso 46. By locating the offset opening 30 as shown in FIG. 2, the heart is not subject to the same impact forces as with a front center opening where the heart is more exposed.

The pair of lateral portions 26 further has the multi-layered padding 14 sized, shaped and constructed to provide protection from impact to the lateral regions, unhindered movement of the legs and flexibility to accommodate varying torso sizes as shown in FIG. 4. Excellent results are obtained when the multi-layered padding 14 in the pair of lateral portions 26 is 1/64 inch to 1½ inch thick and comprised of elastic fabric-covered Neoprene padding 38.

Figure 3:
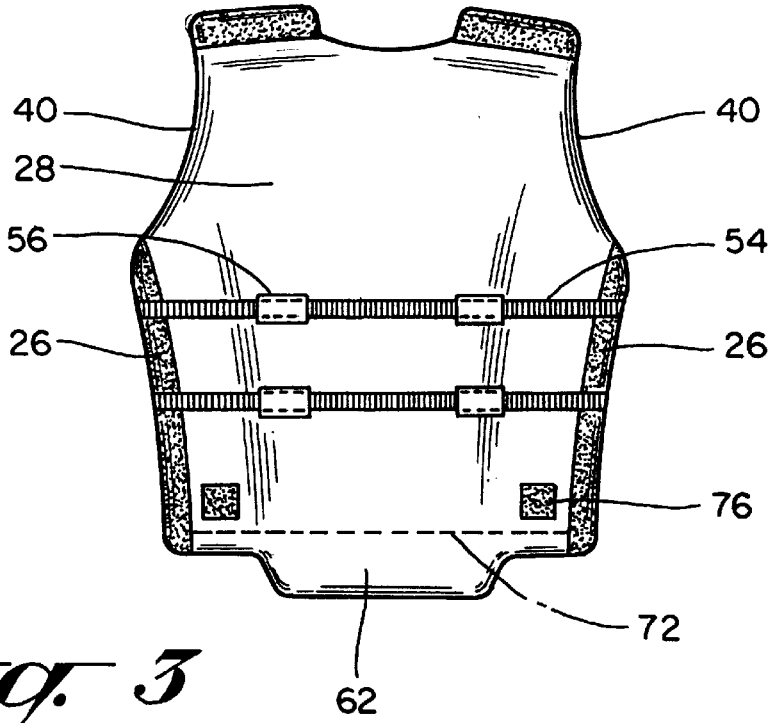
FIG. 3 is a posterior view of the present invention showing the tapered design in the inferior-most region of the posterior portion.

The posterior portion 28 further has the multi-layered padding 14 sized and shaped to provide protection from impact to the back and allow unhindered movement of the legs as shown in FIG. 3. Excellent results are obtained when the multi-layered padding 14 is 1/64 inch to 1½ inch thick in the posterior portion 28. In order to both protect the lower spine area and allow unhindered movement of the legs, the posterior portion 28 is shaped in a tapered design 62 in the inferior-most region as shown in FIG. 3.

In order to enable the athlete to customize the protective padding for safety, comfort and athletic performance purposes, the posterior portion 28 of the vest further contains a slot or opening 72 on the interior or exterior surface or the first layer 16 or the third layer 20 of the multi-layered padding 14 allowing for the removal or insertion of the second, or middle layer 18, or a layer or layers, or a portion or portions, or a section or sections thereof, from the vest 12. The posterior portion 28 further has the first layer 16 and the third layer 20 of the multi-layered padding 14 being formed from an air-permeable, moisture-wicking material to allow for the cooling of the underlying torso. Excellent results are obtained when the material in the first layer 16 and the third layer 20 of the multi-layered padding 14 is made from a fabric similar in texture, durability, air permeability and moisture-wicking capability to CORDURA Nylon or COOLMAX. The posterior portion 28 further contains at least one holder or fastener 76 for securing a removable strip of fabric or flag (not shown). Excellent results are obtained when the holder or fastener 76 is comprised of a VELCRO strip.

Figure 9:
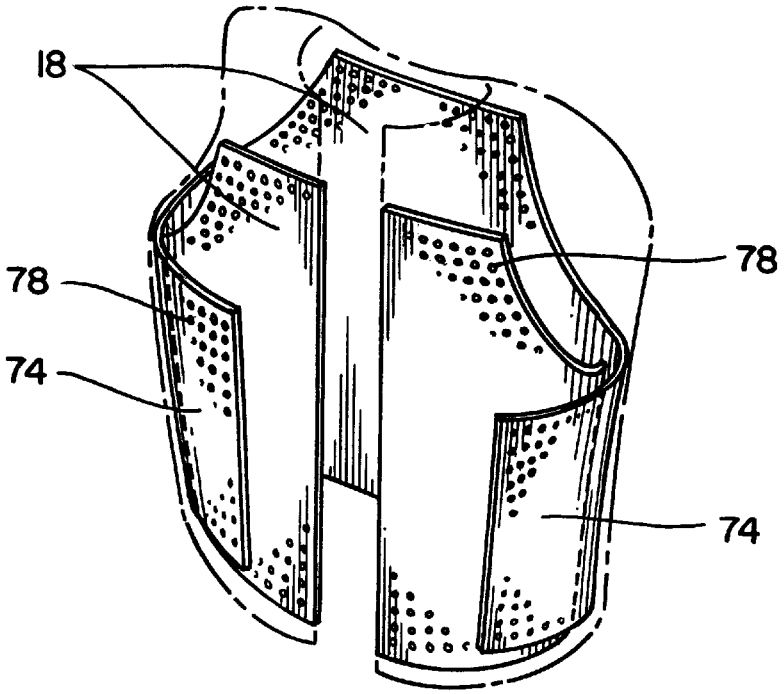
FIG. 9 is a perspective view of the present invention with parts broken away to illustrate the second, or middle layer of the multi-layered padding in the anterior and posterior portions extending over and overlapping in the pair of lateral portions.

In order to provide protection to the whole torso, as shown in FIG. 9, the lateral most edges of the second layer 18 of the multi-layered padding 14 in the anterior portion 24 and/or the posterior portion 28 of the vest 12, or a layer thereof, extend over and/or overlap 74 in the pair of lateral portions 26 of the vest 12 in order to maintain a second layer 18 of the multi-layered padding 14 between the first layer 16 and third layer 20 in the pair of lateral portions 26 of the vest 12 as the vest 12 stretches horizontally to accommodate larger torso sizes.

A key aspect of the preferred embodiment is a flap 48, shown in FIG. 2 affixed over the offset opening 30, sized and shaped to provide protection to the region of the offset opening 30 and cover the area of the vest 12 about the offset opening 30. Excellent results are obtained when the multi-layered padding 14 in the flap 48 is 1/64 inch to 1 inch thick.

As shown in FIGS. 1 and 2, the flap 48 is attached to the first anterior side 42 and fastened across the offset opening 30 by a fastening means 50 located on the underside of the flap 48 and correspondingly on the exterior surface of the first anterior side 42 of the vest 12. In the preferred embodiment, the flap 48 is stitched onto the first anterior side 42 and fastened to the second anterior side 44 by VELCRO. In order to facilitate the donning/removal of the vest 12, the free end of the flap 48 can be temporarily attached to the second anterior side 42 by a flap fastening means 60 attached to the exterior surface of the flap 48 and correspondingly on the exposed exterior surface of the second anterior side 44 of the vest 12, as shown in FIG. 2. Excellent results are obtained when the fastening means 60 is comprised of a VELCRO strip to temporally hold the flap 48 away from the offset opening 30 while the athlete puts on the vest 12.

In order to secure the vest 12 around the torso, a fastening device 52 is attached about the offset opening 30, as shown in FIG. 1, to engage the first anterior side 42 of the vest 12 to the second anterior side 44 of the vest 12 when fastened. Excellent results are obtained when the fastening device 52 is comprised of side pressure release-type belt fasteners or buckles as shown in FIG. 1.

In order to further secure the vest 12 around the torso, adjustable securing belts 54 are wrapped around the vest 12 as shown in FIGS. 2 and 3. The adjustable securing belts 54 are held around the vest 12 by being placed through vertical loops 56 attached about the vest 12. In the preferred embodiment, the vertical loops 56 are stitched into the vest 12, although other means of attaching the vertical loops 56 can be utilized. The adjustable securing belts 54 are attached to belt fasteners 58. After the athlete puts on the vest 12, the adjustable securing belts 54 are fastened and pulled to a proper fit, as shown in FIG. 2. In the preferred embodiment, the belt fasteners 58 are side pressure release-type belt fasteners or buckles, although ladder locks would probably be utilized if the adjustable securing belts only partially encircled the vest The adjustable securing belts 54 are fastened by the belt fasteners 58 about the offset opening 30 in order for the belt fasteners 58 to be covered by the flap 48 as shown in FIG. 2. Thus, the belt fasteners 58 are sized and shaped to fasten under the flap 48, providing further protection as the flap 48 will cover the belt fasteners 58 and prohibit them from catching during sporting activities.

The second, or middle layer 18 or the multi-layered padding 14, or portions or layers thereof, further is punctuated with a plurality of air holes 78 to provide for the cooling of the underlying torso.

Figure 6:
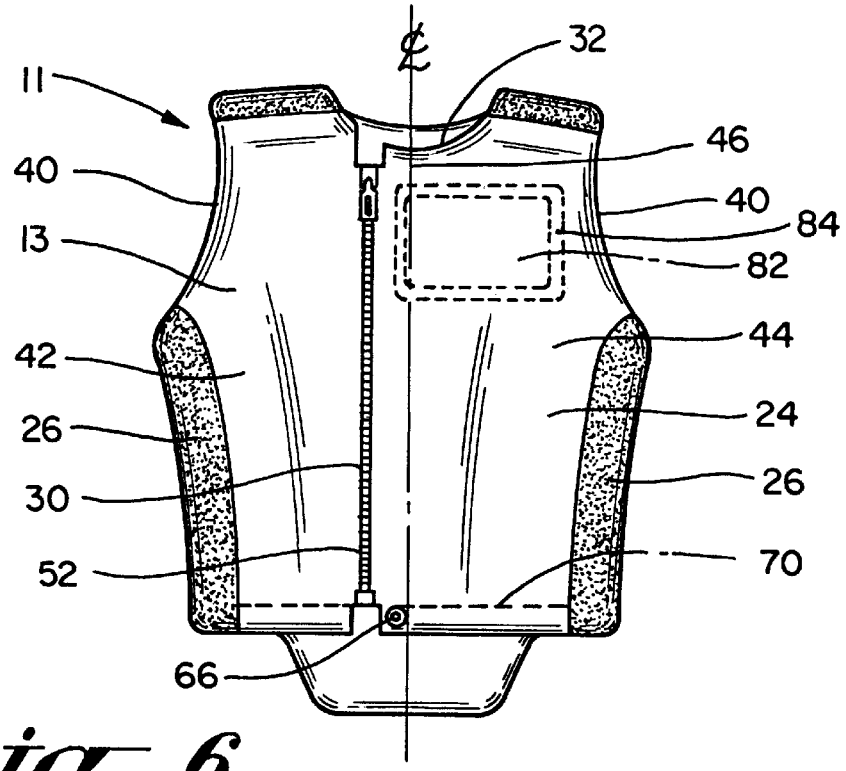
FIG. 6 is a front view of an alternative embodiment with the offset opening and a fastening device.
Figure 7:
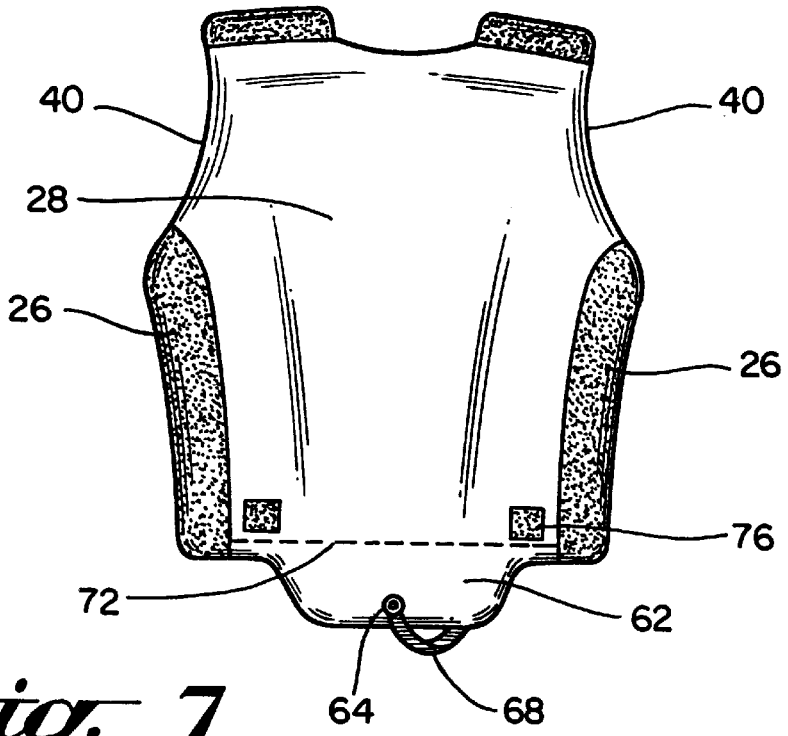
FIG. 7 is a posterior view of the alternative embodiment showing the tapered design in the inferior-most region of the posterior portion.

Another embodiment of the present invention comprises a multi-section, one-piece garment 11 for protecting against impact upon a human torso when worn by an athlete during sporting activities. The multi-section, one-piece garment 11 comprises of a vest 13 sized and shaped to be worn on a torso by an athlete having a multi-layered padding 14, a shoulder portion 22, an anterior portion 24, a pair of lateral portions 26, a posterior portion 28 and an offset opening 30, as shown in FIGS. 5, 6 and 7.

As shown in FIG. 5, the multi-layered padding 14 contains a first, or outer layer 16, a second, or middle layer 18 and a third, or inner layer 20. The first layer 16 and the third layer 20 of the multi-layered padding 14 sandwich, or are joined at a seam to provide a shell for, the second, or middle layer 18, the second layer 18 being formed from a padding material. As is common practice, a welting may be inserted in the seam where the first layer 16 and third layer 20 are joined to form the shell. Excellent results are obtained when second layer 18 of the multi-layered padding 14 is made from polymeric cellular foam similar in texture, sponginess, flexibility, pliability, resiliency and strength resilience to Polyethylene or Polyvinyl Chloride. As shown in FIG. 9, further excellent results are obtained when the second layer 18 of the multi-layered padding 14, or portions or layers thereof, is punctuated with a plurality of air holes 78 to provide for the cooling of the underlying torso.

In order for an athlete to perform optimally, unhindered movement of the arms and neck is necessary. Accordingly, as shown in FIGS. 6 and 7, the shoulder portion 22 has the multi-layered padding 14 sized, shaped and constructed to provide protection against impact to the shoulder area, unhindered movement of the arms and neck and flexibility to accommodate varying torso sizes. Excellent results are obtained when the multi-layered padding 14 in the shoulder portion 22 is comprised of elastic fabric-covered Neoprene padding 38. The shoulder portion 22 further contains a pair of oversized apertures 40, as shown in FIGS. 6 and 7, leaving the shoulder area in an unhindered condition and allowing full movement of the arms.

The anterior portion 24 has the multi-layered padding 14 sized and shaped to allow unhindered movement of the legs and to provide protection against impact to the chest, heart, spleen and abdomen.

An important feature of this embodiment of our invention is an offset opening 30 as shown in FIG. 6. Increased safety is attained when the vest 13 has an offset opening 30. In this embodiment, the offset opening 30 is located offset from the medial line of a human torso 46. By locating the offset opening 30 as shown in FIG. 6, the heart is not subject to the same impact forces as with a front center opening where the heart is more exposed.

The pair of lateral portions 26 further protects the torso by having the multi-layered padding 14 sized, shaped and constructed to provide protection from impact to the lateral regions, unhindered movement of the legs and flexibility to accommodate varying torso sizes, as shown in FIG. 4. Excellent results are obtained when the multi-layered padding 14 in the pair of lateral portions 26 is comprised of elastic fabric-covered Neoprene padding 38.

The posterior portion 28 further protects the torso by having the multi-layered padding 14 sized and shaped to provide protection from impact to the back as shown in FIG. 7. In order to provide both protection to the lower spine area and unhindered movement of the legs, the posterior portion 28 is shaped in a tapered design 62 in the inferior-most region as shown in FIG. 7. The posterior portion 28 further contains a back strap fastener 64 in the inferior-most region that connects to a front strap fastener 66 on the inferior-most region of the anterior portion 24 by a strap 68 as shown in FIG. 7. The stray 68, which runs between the legs, connects the posterior portion 28 to the anterior portion 24 to provide a more secure, more contoured fit of the vest 13 on the athlete.

In order to enable the athlete to customize the protective padding for safety, comfort or athletic performance purposes, the posterior portion 28 further contains a slot or opening 72 on the interior or exterior surface or the first layer 16 or the third layer 20 of the multi-layered padding 14 allowing for the removal or insertion of the second layer 18, or a layer or layers, or a portion or portions, or a section or sections thereof, from the vest 13. The posterior portion 28 further has the first layer 16 and the third layer 20 of the multi-layered padding 14 being formed from an air-permeable, moisture-wicking material to allow for the cooling of the underlying torso. Excellent results are obtained when the material in the first layer 16 and the third layer 20 of the multi-layered padding 14 is made from a fabric similar in texture, durability, air permeability and moisture-wicking capability to CORDURA Nylon or COOLMAX. The posterior portion 28 further contains at least one holder or fastener 76 for securing a strip of fabric or flag (not shown). Excellent results are obtained when the holder or fastener 76 is comprised of a VELCRO strip.

The anterior portion 24 further has the first layer 16 and the third layer 20 of the multi-layered padding 14 being formed from an air-permeable, moisture-wicking material to allow for the cooling of the underlying torso. Excellent results are obtained when the material in the first layer 16 and the third layer 20 of the multi-layered padding 14 is made from a fabric similar in texture, durability, air permeability and moisture-wicking capability to CORDURA Nylon or COOLMAX.

In order to secure the vest 12 around the torso, a fastening device 52 is attached about the offset opening 30, as shown in FIG. 6, to engage the first anterior side 42 of the vest 13 to the second anterior side 44 of the vest 13 when fastened. Excellent results are obtained when the fastening device 52 is comprised of a zipper mechanism as shown in FIG. 6. As is common practice, a strip or strips of material or padding are affixed to the vest under the zipper, effectively providing a protective barrier between the zipper and the underlying clothing/torso. This protective barrier eliminates possible "catches" of the clothing/torso, which would interfere with the operation of the zipper, protects the underlying torso from being cut or otherwise injured by the zipper and provides protection to the underlying torso from impact in the area of the zipper. Excellent results are obtained when the strip or strips of material or padding are comprised of elastic fabric-covered Neoprene padding. As is additionally a common practice, a strip or strips of material or padding are affixed to the vest over the zipper, effectively providing a protective barrier over the zipper. This protective barrier eliminates possible "catches" of the zipper and provides further protection to the underlying torso from impact in the area of the zipper. Excellent results are obtained when the strip or strips material or padding are comprised of elastic fabric-covered Neoprene padding. As is further common practice, a zipper pull-tab cover may be affixed to the vest to secure the zipper pull-tab in the down position when the zipper is fastened. Excellent results are obtained when the zipper pull tab cover is comprised of a small strap which is fastened across the zipper pull tab with Velcro when the zipper is fastened, securing the zipper pull tab in the down position.

As shown in FIG. 9, the present invention further has the lateral most edges of the second, or middle layer 18 of the multi-layered padding 14 in the anterior portion 24 and/or the posterior portion 28 of the vest 13, or a layer thereof or layers thereof, extending over and/or overlapping 74 in the pair of lateral portions 26 of the vest 13 for the purpose of maintaining a second layer 18 of the multi-layered padding between the first layer 16 and third layer 20 in the pair of lateral portions 26 of the vest 13 as the vest stretches horizontally to accommodate larger torso sizes.

As shown in FIG. 6, the present invention further has at least one protective pad 82 comprising rigid, semi-rigid or flexible material affixed onto, or inserted into a pocket 84 on, the interior or exterior surface of the first, or outer layer 16 of the multi-layered padding 14, or affixed onto the exterior surface of the second, or middle layer 18 of the multi-layered padding, in the superior region of the second anterior side 44 of the anterior portion 24 and sized and shaped to provide protection from impact to the heart. Excellent results are obtained when the protective pad 82 is comprised of a thermoplastic polymer-based material.

Another embodiment of the present invention comprises a multi-section, one-piece garment 11 for protecting against impact upon a human torso when worn by an athlete during sporting activities. The multi-section, one-piece garment 11 comprises of a vest 13 sized and shaped to be worn on a torso by an athlete having a multi-layered padding 14, a shoulder portion 22, an anterior portion 24, a pair of lateral portions 26, a posterior portion 28 and an overlap 42, as shown in FIGS. 5, 6 and 7.

Virtually identical in outward appearance to the non-overlap, non-flap version of the vest described immediately above, thus the same drawings are referenced, this embodiment of the vest incorporates an overlap 42, wherein the overlap 42 extends past the offset opening and onto the exterior surface of the anterior portion 24. In order to secure the vest around the torso, a fastening device 52 engages the overlap 42 to the anterior portion 24 when fastened.

Referencing FIG. 6, depending on the location of the offset opening (i.e., the edge of the underlying second anterior side 44 or anterior portion 24), which is not shown in FIG. 6 relative to this embodiment, the anterior portion 24 will either be one continuous piece extending across the whole front, and possibly onto the side, or divided into a first anterior side and a second anterior side by the offset opening. In the preferred embodiment, the anterior portion 24 is one continuous piece, with the overlap 42 extending over or overlapping it as depicted.

Figure 8:
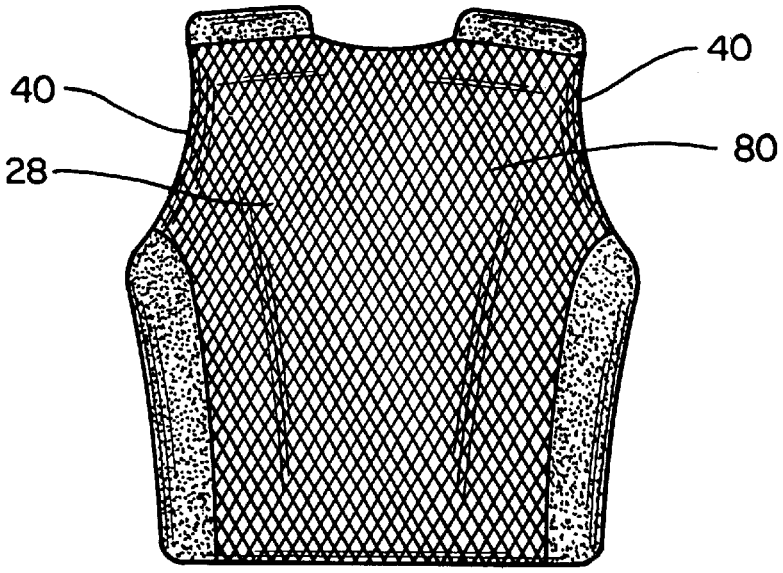
FIG. 8 is a posterior view of an alternative embodiment with air-permeable material in the posterior portion allowing air ventilation to and from the underlying torso.

In another embodiment, the present invention is comprised of a multi-section, one-piece garment 11 for protecting against impact upon a human torso when worn by an athlete during sporting activities. The multi-section, one-piece garment 11 comprises of a vest 13 sized and shaped to be worn on a torso by an athlete including an anterior portion 24, a posterior portion 28, a pair of lateral portions 26, a shoulder portion 22 and an offset opening 30 as shown in FIGS. 6 and 8, the vest 13 having a multi-layered padding 14 in the anterior portion 24, the shoulder portion 22 and the pair of lateral portions 26 to protect the torso of the athlete engaged in a sporting activity, the posterior portion 28 of the vest being comprised of an air-permeable material 80 that allows air ventilation to and from the underlying torso.

The multi-layered padding 14 has a first, or outer layer 16, a second, or middle layer 18 and a third, or inner layer 20 wherein the first layer 16 and the third layer 20 sandwich, or are joined at a seam to provide a shell for, the second 18, the second layer 18 being formed from a padding material. As is common practice, a welting may be inserted in the seam where the first layer 16 and third layer 20 are joined to form the shell.

The offset opening 30 is offset from the medial line of a human torso 46 to protect against impact to the heart.

The present invention further comprises a fastening device 52 to engage the vest when fastened to secure the vest 13 about the torso.

As shown in FIG. 6, the shoulder portion 22 has the multi-layered padding 14 sized, shaped and constructed to provide protection to the shoulder area, unhindered movement of the arms and neck and flexibility to accommodate varying torso sizes. Excellent results are obtained when the multi-layered padding 14 in the shoulder portion 22 is comprised of elastic fabric-covered Neoprene padding 38. The shoulder portion 22 further contains a pair of oversized apertures 40, as shown in FIGS. 6 and 8, leaving the shoulder area in an unhindered condition and allowing full movement of the arms.

The anterior portion 24 has the multi-layered padding 14 sized and shaped to allow unhindered movement of the legs and provide protection against impact to the chest, heart; spleen and abdomen.

The anterior portion 24 further has the first anterior side 42 and the second anterior side 44 as delineated by the offset opening 30 each having a slot or opening 70 on the interior or exterior surface of the first layer 16 or the third layer 20 of the multi-layered padding 14 allowing for the removal or insertion of the second layer 18 of the multi-layered padding 14, or a layer or layers thereof, from the vest 13. The anterior portion 24 further has the first layer 16 and the third layer 20 of the multi-layered padding 14 being formed from an air-permeable, moisture-wicking material to allow for the cooling of the underlying torso. Excellent results are obtained when the material in the first layer 16 and the third layer 20 of the multi-layered padding 14 is made from a fabric similar in texture, durability, air permeability and moisture-wicking capability to CORDURA Nylon or COOLMAX.

The pair of lateral portions 26 further protects the athlete's torso by having the multi-layered padding 14 sized, shaped and constructed to provide protection from impact to the lateral regions, unhindered movement of the legs and flexibility to accommodate varying torso sizes as shown in FIG. 4. Excellent results are obtained when the multi-layered padding 14 in the pair of lateral portions 26 is comprised of elastic fabric-covered Neoprene padding 38.

The posterior portion 28 further contains a least one holder or fastener 76 for securing a removable strip of fabric or flag (not shown). Excellent results are obtained when the holder or fastener 76 is comprised of a VELCRO strip.

The present invention further has the second layer 18 of the multi-layered padding 14 in the anterior portion 24 of the vest 13, or a layer thereof, extending over or overlapping 74 the pair of lateral portions 26 of the vest 13 for the purpose of maintaining a second layer 18 of the multi-layered padding 14 between the first layer 16 and third layer 20 in the pair of lateral portions 26 of the vest 13 as the vest stretches horizontally to accommodate larger torso sizes.

As represented by the dotted-line sections of FIG. 4, each of the embodiments of the invention described above can, with slight modification be worn by a mature female athlete. As shown in FIG. 4, a convex configuration 34 in the superior region of the anterior portion 24 provides space for receiving the female breasts and a concave configuration 36 in the inferior-most region of the pair of lateral portions 26 provides space for receiving the female hips.

As various possible embodiments may be made in the above invention for use for different purposes and as various changes might be made in the embodiments and methods above set forth, and as the details concerning certain common practices may not have been included, it is understood that all of the above matters here set forth or shown in the accompanying drawings are to be interpreted as illustrative and not in a limiting sense.

What is claimed is:

1. A multi-section, one-piece garment for protecting against impact upon a human torso when worn by an athlete during sporting activities comprising:

a vest sized and shaped to be worn on a torso of an athlete, the vest having a multi-layered padding to protect the torso of the athlete, including a chest, an abdomen, a pair of sides, a shoulder area and a back, the vest further comprising a shoulder portion, an anterior portion, a pair of lateral portions, a posterior portion and an offset opening, the multi-layered padding having a first, or outer layer, a second, or middle layer and a third, or inner layer, wherein the first and third layers sandwich, or are joined at a seam to provide a shell for, the second layer, the second layer of the multi-layered padding being formed from a padding material to protect the torso, the shoulder portion having the multi-layered padding sized, shaped and constructed to provide protection to the shoulder area and permit unhindered movement of the arms and neck, the shoulder portion having the multi-layered padding being 1/64 inch to 1½ inch thick, the shoulder portion further having a pair of oversized apertures located at the lateral most regions for receiving the arms, each oversized aperture being sized and shaped to permit full movement of the arm, the anterior portion having the multi-layered padding sized and shaped to allow unhindered movement of the legs and to protect against impact to the chest, heart, spleen and abdomen, the anterior portion having the multi-layered padding being 1/64 inch to 1½ inch thick, the offset opening being off set from the medial line of a human torso to protect the heart against impact, the pair of lateral portions being located inferior to the pair of oversized apertures, each lateral portion having the multi-layered padding sized, shaped and constructed to provide protection against impact to the lateral region and allow unhindered movement of the leg, each lateral portion having the multi-layered padding being 1/64 inch to 1½ inch thick, the posterior portion having the multi-layered padding being 1/64 inch to 1½ inch thick to protect against impact to the back and allow unhindered movement of the legs;

at least one slot or opening located on the interior or exterior surface or the first or third layer of the multi-layered padding, or in the seam where the first and third layers are joined to form the shell, which may or may not have a fastening device or devices to secure it in a closed position, allowing for removal or insertion of the second layer of the multi-layered padding, or a layer or layers, or a portion or portions, or a section or sections thereof, from the vest;

an overlap or flap, the overlap or flap extending or being located over the offset opening and sized and shaped to protect the region of the offset opening against impact and cover the area of the vest about the offset opening, the overlap or flap being 1/64 inch to 1inch thick, the overlap or flap extending from or being attached to the vest and fastened across the offset opening by a fastening means to secure the vest on the torso.

2. The multi-section, one-piece garment of claim 1, wherein at least one adjustable securing belt-like device such as a belt, strap or drawstring is wrapped around the multi-layered padding, or partially thereof, on the first, or outer layer, the second, or middle layer, or a layer thereof, or the first and second layer alternately, of the vest to secure the vest about the torso, the adjustable securing belt-like device being inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

3. The multi-section, one-piece garment of claim 1, wherein the superior regions of the anterior portion and the overlap or flap are shaped in a convex configuration, wherein the convex configuration provides space for receiving breasts.

4. The multi-section, one-piece garment of claim 1, wherein the inferior-most regions of the pair of lateral portions are shaped in a concave configuration, wherein the concave configuration provides space for receiving the hip.

5. The multi-section, one-piece garment of claim 1, wherein the posterior portion contains at least one holder or fastener for securing a removable strip of fabric or flag.

6. The multi-section, one-piece garment of claim 1, wherein the flap further comprises at least one fastening means attached on its exterior surface and correspondingly on the exposed exterior surface of the vest to secure the flap in a open position on the front of the vest.

7. The multi-section, one-piece garment of claim 1, wherein the multi-layered padding, or a layer or layers thereof is punctuated with a plurality of air holes to provide for the cooling of the underlying torso.

8. The multi-section, one-piece garment of claim 1, wherein the posterior portion is shaped in a tapered design in the inferior-most region to provide protection to the lower spine area and allow unhindered movement of the legs.

9. The multi-section, one-piece garment of claim 1, wherein a protective pad or pads comprising rigid, semi-rigid or flexible material are affixed onto, and/or inserted into a pocket on, the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layer thereof, of the anterior portion and sized and shaped to provide protection from impact to the heart and/or spleen, the protective pad or pads being removable and insertable by the wearer, with access to the interior of the shell provided via either the slot or opening that allows for the removal or insertion of the second, or middle layer of the multi-layer padding from the vest, or a separate slot or located opening on the interior or exterior surface of the shell, or in the seam where the first and third layers of the multi-layer padding are joined to form the shell, which may or may not be secured in a closed position by a fastening device or devices.

10. The multi-section, one-piece garment of claim 1, wherein the first layer and/or second layer and/or third layer of the multi-layered padding, or portions or sections thereof, is comprised of multiple layers.

11. The multi-section, one-piece garment of claim 1, wherein the inferior-most region of the posterior portion contains a back strap fastener therein to connect to a front strap fastener located on the anterior portion by a strap therein to engage the posterior portion to the anterior portion.

12. The multi-section, one-piece garment of claim 1, wherein a fastening device is attached about the offset opening, the fastening device being fastened to secure the vest about the torso.

13. The multi-section, one-piece garment of claim 1, wherein the pair of lateral portions have the multi-layered padding, or a layer or layers thereof, being comprised of elastic material.

14. The multi-section, one-piece garment of claim 1, wherein the shoulder portion has the multi-layered padding, or a layer or layers thereof being comprised of elastic material.

15. The multi-section, one-piece garment of claim 1, wherein the first and/or third layers of the multi-layered padding being formed from an air-permeable and/or wicking material to allow for the cooling of the underlying torso.

16. The multi-section, one-piece garment of claim 1, wherein the second layer of the multi-layered padding being formed from polymeric cellular foam to protect the torso.

17. The multi-section, one-piece garment of claim 1, wherein the lateral most edges of the second layer of the multi-layered padding in the anterior portion and/or posterior portion of the vest, or a layer thereof extending over and/or overlapping in the pair of lateral portions of the vest, the lateral most edges of the second layer of the multi-layered padding in the anterior and/or posterior portion of the vest, or a layer thereof extending over and/or overlapping in the pair of lateral portions of the vest for the purpose of maintaining a second layer of the multi-layered padding between the first and third layers in the pair of lateral portions of the vest as the vest stretches horizontally to accommodate larger torso sizes.

18. The multi-section, one-piece garment of claim 1, wherein the shoulder portion, or a section or sections thereof, has the multi-layered padding consisting of only the outer layer and the inner layer to permit unhindered movement of the arms and neck.

19. The multi-section, one-piece garment of claim 1, wherein the lateral portions, or a section or sections thereof, has the multi-layered padding consisting of only the outer layer and the inner layer to permit unhindered movement of the legs and torso and provide for the cooling of the underlying torso.

20. The multi-section, one-piece garment of claim 1, wherein the multi-layer padding in a portion or portions of the vest consists of only the first and third or outer and inner layers at or over openings, seams, breaks, slits, cuts or cut outs in the second, or middle layer of the multi-layer padding.

21. A multi-section, one-piece garment for protecting against impact upon a human torso when worn by an athlete during sporting activities, the multi-section, one-piece garment comprising:

a vest sized and shaped to be worn on a torso of an athlete, the vest having a multi-layered padding to protect the torso of the athlete including a chest, an abdomen, a pair of lateral regions, a shoulder area and a back, the vest further comprising a shoulder portion, an anterior portion, a pair of lateral portions, a posterior portion and an offset opening, the multi-layered padding having a first or outer layer, a second, or middle layer, and a third, or inner layer, wherein the first and third layers sandwich, or are joined at a seam to provide a shell for, the second layer, the second layer being formed from a padding material for protecting against impact to the torso, the shoulder portion having a pair of oversized apertures located at the lateral most regions for receiving the arms, each oversized aperture being sized and shaped to permit full movement of the arm, at least one slot or opening located on the interior or exterior surface or the first or third layer of the multi-layered padding, or in the seam where the first and third layers are joined to form the shell, which may or may not have a fastening device or devices to secure it in a closed position, allowing for removal or insertion of the second layer of the multi-layered padding, or a layer or layers, or a portion or portions, or a section or sections thereof, from the vest, the offset opening being located off set from the medial line of a human torso to protect the heart against impact;

an overlap or flap, the overlap or flap extending or being located over the offset opening, the overlap or flap being sized and shaped to protect against impact in the region of the offset opening and cover the area of the vest about the offset opening, the overlap or flap extending from or being attached to the vest and fastened across the offset opening by a fastening means to secure the vest on the torso.

22. The multi-section, one-piece garment of claim 21, wherein the shoulder portion further having the multi-layered padding sized and shaped to provide protection to the shoulder area and permit unhindered movement of the arms and neck, the shoulder portion further having the multi-layered padding being 1/64 inch to 1½ inch thick.

23. The multi-section, one-piece garment of claim 21, wherein the anterior portion has the multi-layered padding being sized and shaped to allow unhindered movement of the legs and protect against impact to the chest, heart, spleen and abdomen, the anterior portion further having the multi-layered padding being 1/64 inch to 1½ inch thick.

24. The multi-section, one-piece garment of claim 21, wherein the pair of lateral portions are located inferior to the pair of oversized apertures, each lateral portion further having the multi-layered padding sized and shaped to allow unhindered movement of the leg and protect against impact to the lateral region, each lateral portion further having the multi-layered padding being 1/64 inch to 1½ inch thick.

25. The multi-section, one-piece garment of claim 21, wherein the posterior portion having the multi-layered padding being sized and shaped to protect against impact to the back and permit unhindered movement of the legs, the posterior portion further having the multi-layered padding being 1/64 inch 1½ inch thick.

26. The multi-section, one-piece garment of claim 21, wherein the overlap or flap being sized and shaped to protect against impact in the region of the offset opening and cover the area of the vest about the offset opening, the overlap or flap further being 1/64 inch to 1 inch thick.

27. The multi-section, one-piece garment of claim 21, wherein the second, or middle layer of the multi-layered padding being formed from polymeric cellular foam to protect the torso against impact.

28. The multi-section, one-piece garment of claim 21, wherein a fastening device is attached about the offset opening, the fastening device being fastened to secure the vest about the torso.

29. The multi-section, one-piece garment of claim 21, wherein at least one adjustable securing belt-like device such as a belt, strap or drawstring is wrapped around the multi-layered padding, or partially thereof, on the first, or outer layer, the second, or middle layer, or a layer thereof, or the first and second layer alternately, of the vest to secure the vest about the torso, the adjustable securing belt-like device being inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

30. The multi-section, one-piece garment of claim 21, wherein the posterior portion containing at least one holder or fastener for securing a removable strip of fabric or flag.

31. The multi-section, one-piece garment of claim 21, wherein the flap containing at least one fastening means attached on its exterior surface and correspondingly on the exposed exterior surface of the vest to secure the flap in a open position on the vest.

32. The multi-section, one-piece garment of claim 21, wherein the superior regions of the anterior portion and the overlap or flap are shaped in a convex configuration, the convex configuration providing space for receiving breasts.

33. The multi-section, one-piece garment of claim 21, wherein the inferior-most regions of the pair of lateral portions are shaped in a concave configuration, the concave configuration providing space for receiving the hip.

34. The multi-section, one-piece garment of claim 21, wherein the first layer and/or second layer and/or third layer of the multi-layered padding, or portions or sections thereof, is comprised of multiple layers.

35. The multi-section, one-piece garment of claim 21, wherein the multi-layered padding, or a layer or layers thereof, is punctuated with a plurality of air holes to provide for the cooling of the underlying torso.

36. The multi-section, one-piece garment of claim 21, wherein the first and/or third layers of the multi-layered padding being formed from an air-permeable and/or wicking material to allow for the cooling of the underlying torso.

37. The multi-section, one-piece garment of claim 21, wherein a protective pad or pads comprising rigid, semi-rigid or flexible material are affixed onto, and/or inserted into a pocket on, the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, of the anterior portion and sized and shaped to provide protection from impact to the heart and/or spleen, the protective pad or pads being removable and insertable by the wearer, with access to the interior of the shell provided via either the slot or opening that allows for the removal or insertion of the second, or middle layer of the multi-layer padding from the vest or a separate slot or located opening on the interior or exterior surface of the shell, or in the seam where the first and third layers of the multi-layer padding are joined to form the shell, which may or may not be secured in a closed position by a fastening device or devices.

38. The multi-section, one-piece garment of claim 21, wherein the inferior-most region of the posterior portion contains a back strap fastener therein to connect to a front strap fastener located on the anterior portion by a strap therein to engage the posterior portion to the anterior portion.

39. The multi-section, one-piece garment of claim 22, wherein the shoulder portion further has the multi-layered padding, or a layer or layers thereof being comprised of elastic material.

40. The multi-section, one-piece garment of claim 24, wherein the pair of lateral portions has the multi-layered padding, or a layer or layers thereof, being comprised of elastic material.

41. The multi-section, one-piece garment of claim 25, wherein the posterior portion being shaped in a tapered design in the inferior-most region to provide protection to the lower spine area and allow unhindered movement of the legs.

42. The multi-section, one-piece garment of claim 21, wherein the lateral most edges of the second layer of the multi-layered padding in the anterior portion and/or posterior portion of the vest, or a layer thereof, extend over and/or overlap in the pair of lateral portions of the vest for the purpose of maintaining a second layer of the multi-layered padding between the first and third layers in the pair of lateral portions of the vest as the vest stretches horizontally to accommodate larger torso sizes.

43. The multi-section, one-piece garment of claim 22, wherein the shoulder portion, or a section or sections thereof, has the multi-layered padding consisting of only the outer layer and the inner layer to permit unhindered movement of the arms and neck.

44. The multi-section, one-piece garment of claim 24, wherein the lateral portions, or a section or sections thereof, has the multi-layered padding consisting of only the outer layer and the inner layer to permit unhindered movement of the legs and torso and provide for the cooling of the underlying torso.

45. The multi-section, one-piece garment of claim 21, wherein the multi-layer padding in a portion or portions of the vest consists of only the first and third or outer and inner layers at or over openings, seams, breaks, slits, cuts or cut outs in the second, or middle layer of the multi-layer padding.

46. A multi-section, one-piece garment for protecting against impact upon a human torso when worn by an athlete during sporting activities, the multi-section, one-piece garment comprising:

a vest sized and shaped to be worn on a torso of an athlete, the vest having a multi-layered padding to protect the torso of the athlete including a chest, an abdomen, a pair of lateral regions, a shoulder area and a back, the vest further comprising a shoulder portion, an anterior portion, a pair of lateral portions, a posterior portion, and an offset opening, the multi-layered padding having a first, or outer layer, a second, or middle layer and a third, or inner layer, wherein the first and third layers sandwich, or are joined at a seam to provide a shell for, second layer, the second layer being formed from a padding material for protecting against impact to the torso, the offset opening being located off set from the medial line of a human torso to protect the heart against impact;

an overlap or flap, the overlap or flap extending or being located over the offset opening to protect the region of offset opening against impact and cover the area of the vest about the offset opening, the overlap or flap extending from or being attached to the vest and fastened across the offset opening by a fastening means to secure the vest on the torso.

47. The multi-section, one-piece garment of claim 46, wherein the shoulder portion having the multi-layered padding sized and shaped to protect the shoulder area and permit unhindered movement of the arm and neck, the shoulder portion further having a pair of oversized apertures located at the lateral most regions for receiving the arms, each oversized aperture being sized and shaped to permit full movement of the arm.

48. The multi-section, one-piece garment of claim 46, wherein the anterior and pair of lateral portions have the multi-layered padding sized and shaped to allow unhindered movement of the legs and to protect against impact to the chest, heart, spleen, abdomen and lateral regions.

49. The multi-section, one-piece garment of claim 46, wherein the posterior portion has the multi-layered padding sized and shaped to protect against impact to the back.

50. The multi-section, one-piece garment of claim 46, wherein a fastening device is attached about the offset opening, the fastening device being fastened to secure the vest about the torso.

51. The multi-section, one-piece garment of claim 46, wherein at least one adjustable securing belt-like device such as a belt, strap or drawstring is wrapped around the multi-layered padding, or partially thereof, on the first, or outer layer, the second, or middle layer, or a layer thereof, or the first and second layer alternately, of the vest to secure the vest about the torso, the adjustable securing belt-like device being inserted through a vertical loop or loops and/or a slot or slots and/or an opening or openings, the vertical loop or loops being attached to the vest and the slot or slots and/or opening or openings being located in the first, or outer layer and/or third, or inner layer of the vest to hold the adjustable securing belt-like device around the torso, the adjustable securing belt-like device being fastened by a belt-like device fastener or fasteners.

52. The multi-section, one-piece garment of claim 46, wherein at least one slot or opening located on the interior or exterior surface or the first or third layer of the multi-layered padding, or in the seam where the first and third layers are joined to form the shell, which may or may not have a fastening device or devices to secure it in a closed position, allows for the removal or insertion of the second layer of the multi-layered padding, or a layer or layers, or a portion or portions, or a section or sections thereof, from the vest.

53. The multi-section, one-piece garment of claim 46, wherein the overlap or flap being sized and shaped to provide protection from impact to the region of the offset opening and cover the area of the vest about the offset opening.

54. The multi-section, one-piece garment of claim 46, wherein the posterior portion contains at least one holder or fastener for securing a removable strip of fabric or flag.

55. The multi-section, one-piece garment of claim 46, wherein the flap containing at least one fastening means attached on its exterior surface and correspondingly on the exposed exterior surface of the vest to secure the flap in a open position on the vest.

56. The multi-section, one-piece garment of claim 46, wherein the first layer and/or second layer and/or third layer of the multi-layered padding, or portions or sections hereof, is comprised of multiple layers.

57. The multi-section, one-piece garment of claim 46, wherein the multi-layered padding, or a layer or layers thereof, is punctuated with a plurality of air holes to provide for the cooling of the underlying torso.

58. The multi-section, one-piece garment of claim 46, wherein the superior regions of the anterior portion and the overlap or flap are shaped in a convex configuration, the convex configuration providing space for receiving breasts.

59. The multi-section, one-piece garment of claim 46, wherein the inferior-most regions of the pair of lateral portions are shaped in a concave configuration, the concave configuration providing space for receiving the hip.

60. The multi-section, one-piece garment of claim 46, wherein the first and/or third layers of the multi-layered padding being formed from an air-permeable and/or wicking material to allow for the cooling of the underlying torso.

61. The multi-section, one-piece garment of claim 46, wherein a protective pad or pads comprising rigid, semi-rigid or flexible material are affixed onto, and/or inserted into a pocket on, the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, of the anterior portion and sized and shaped to provide protection from impact to the heart and/or spleen, the protective pad or pads being removable and insertable by the wearer, with access to the interior of the shell provided via either the slot or opening that allows for the removal or insertion of the second, or middle layer of the multi-layer padding from the vest, or a separate slot or located opening on the interior or exterior surface of the shell or in the seam where the first and third layers of the multi-layer padding are joined to from the shell, which may or may not be secured in a closed position by a fastening device or devices.

62. The multi-section, one-piece garment of claim 46, wherein the inferior-most region of the posterior portion contains a back strap fastener therein to connect to a front strap fastener located on the anterior portion by a strap therein to engage the posterior portion to the anterior portion.

63. The multi-section, one-piece garment of claim 47, wherein the shoulder portion having the multi-layered padding, or a layer or layers thereof, being comprised of elastic material.

64. The multi-section, one-piece garment of claim 48, wherein the pair of lateral portions has the multi-layered padding, or a layer or layers thereof, being comprised of elastic material.

65. The multi-section, one-piece garment of claim 49, wherein the posterior portion being shaped in a tapered design in the inferior-most region to provide protection to the lower spine area and allow unhindered movement of the legs.

66. The multi-section, one-piece garment of claim 46, wherein the lateral most edges of the second layer of the multi-layered padding in the anterior portion and/or posterior portion of the vest, or a layer thereof, extend over and/or overlap in the pair of lateral portions of the vest for the purpose of maintaining a second layer of the multi-layered padding between the first and third layers in the pair of lateral portions of the vest as the vest stretches horizontally to accommodate larger torso sizes.

67. The multi-section, one-piece garment of claim 47, wherein the shoulder portion, or a section or sections thereof, has the multi-layered padding consisting of only the outer layer and the inner layer to permit unhindered movement of the arms and neck.

68. The multi-section, one-piece garment of claim 48, wherein the lateral portions, or a section or sections thereof, has the multi-layered padding consisting of only the outer layer and the inner layer to permit unhindered movement of the legs and torso and provide for the cooling of the underlying torso.

69. The multi-section, one-piece garment of claim 46, wherein the multi-layer padding in a portion or portions of the vest consists of only the first and third or outer and inner layers at or over openings, seams, breaks, slits, cuts or cut outs in the second, or middle layer of the multi-layer padding.

70. A multi-section, one-piece garment for protecting against impact upon a human torso when worn by an athlete during sporting activities, the multi-section, one-piece garment comprising:

a vest sized and shaped to be worn on a torso of an athlete, the vest having a multi-layered padding to protect the torso of the athlete including a chest, an abdomen, a pair of lateral regions, a shoulder area and a back, the vest further comprising a shoulder portion, an anterior portion, a pair of lateral portions, a posterior portion and an offset opening, the multi-layered padding having three layers, wherein the first, or outer layer and the third, or inner layer of the multi-layered padding sandwich, or are joined at a seam to provide a shell for, the second, or middle layer, the second layer being formed from a padding material for protecting against impact to the torso, the shoulder portion having a pair of oversized apertures located at the lateral most regions for receiving the arms, each oversized aperture being sized and shaped to permit full movement of the arm, the offset opening being offset from the medial line of a human torso to protect the heart against impact;

the vest having a fastening device or devices, the fastening device or devices being fastened to secure the vest about the torso.

71. The multi-section, one-piece garment of claim 70, wherein the anterior portion and pair of lateral portions have the multi-layered padding sized and shaped to allow unhindered movement of the legs and protect the chest, heart, spleen, abdomen and lateral regions against impact.

72. The multi-section, one-piece garment of claim 71, wherein the pair of lateral portions have the multi-layered padding, or a layer or layers thereof, being comprised of elastic material.

73. The multi-section, one-piece garment of claim 70, wherein the lateral most edges of the second layer of the multi-layered padding in the anterior portion and/or posterior portion of the vest, or a layer thereof, extend over and/or overlap in the pair of lateral portions of the vest for the purpose of maintaining a second layer of the multi-layered padding between the first and third layers in the pair of lateral portions of the vest as the vest stretches horizontally to accommodate larger torso sizes.

74. The multi-section, one-piece garment of claim 70, wherein the shoulder portion has the multi-layered padding sized and shaped to provide protection to the shoulder area and permit unhindered movement of the arms and neck.

75. The multi-section, one-piece garment of claim 74, wherein the shoulder portion having the multi-layered padding, or a layer or layers thereof, being comprised of elastic material.

76. The multi-section, one-piece garment of claim 70, wherein the posterior portion has the multi-layered padding sized and shaped to protect the back against impact.

77. The multi-section, one-piece garment of claim 70, wherein the second layer of the multi-layered padding material being formed from polymeric cellular foam to protect the torso against impact.

78. The multi-section, one-piece garment of claim 70, wherein at least one adjustable securing belt-like device such as a belt, strap or drawstring is wrapped around the multi-layered padding, or partially thereof, on the first, or outer layer, the second, or middle layer, or a layer thereof, or the first and second layer alternately, of the vest to secure the vest about the torso, the adjustable securing belt-like device being inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

79. The multi-section, one-piece garment of claim 70, wherein the superior region of the anterior portion is shaped in a convex configuration, the convex configuration providing space for receiving breasts.

80. The multi-section, one-piece garment of claim 70, wherein the inferior-most regions of the pair of lateral portions are shaped in a concave configuration, the concave configuration providing space for receiving the hip.

81. The multi-section, one-piece garment of claim 70, wherein the posterior portion contains at least one fastener or holder for securing a removable strip of fabric or flag.

82. The multi-section, one-piece garment of claim 70, wherein the first and/or third layers of the multi-layered padding being formed from an air-permeable and/or wicking material to allow for the cooling of the underlying torso.

83. The multi-section, one-piece garment of claim 70, wherein the multi-layered padding, or a layer or layers thereof, is punctuated with a plurality of air holes to provide for the cooling of the underlying torso.

84. The multi-section, one-piece garment of claim 70, wherein at least one slot or opening located on the interior or exterior surface of the first or third layer of the multi-layered padding, or in the seam where the first and third layers are joined to form the shell, which may or may not have a fastening device or devices to secure it in a closed position, allows for the removal or insertion of the second layer of the multi-layered padding, or a layer or layers, or a portion or portions, or a section or sections thereof, from the vest.

85. The multi-section, one-piece garment of claim 70, wherein the first layer and/or second layer and/or third layer of the multi-layered padding, or portions or sections thereof, is comprised of multiple layers.

86. The multi-section, one-piece garment of claim 70, wherein a protective pad or pads comprising rigid, semi-rigid or flexible material are affixed onto, and/or inserted into a pocket on, the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, of the of the anterior portion and sized and shaped to provide protection from impact to the heart and/or spleen, the protective pad or pads being removable and insertable by the wearer, with access to the interior of the shell provided via either the slot or opening that allows for the removal or insertion of the second, or middle layer of the multi-layer padding from the vest, or a separate slot or located opening on the interior or exterior surface of the shell, or in the sewn where the first and third layers of the multi-layer padding are joined to form the shell, which may or may not be secured in a closed position by a fastening device or devices.

87. The multi-section, one-piece garment of claim 76, wherein the posterior portion being shaped in a tapered design in the inferior-most region to provide protection to the lower spine area and allow unhindered movement of the legs.

88. The multi-section, one-piece garment of claim 70, wherein the inferior-most region of the posterior portion contains a back strap fastener therein to connect to a front strap fastener located on the anterior portion by a strap therein to engage the posterior portion to the anterior portion.

89. The multi-section, one-piece garment of claim 74, wherein the shoulder portion, or a section or sections thereof, has the multi-layered padding consisting of only the outer layer and the inner layer to permit unhindered movement of the arms and neck.

90. The multi-section, one-piece garment of claim 71, wherein the lateral portions, or a section or sections thereof, has the multi-layered padding consisting of only the outer layer and the inner layer to permit unhindered movement of the legs and torso and provide for the cooling of the underlying torso.

91. The multi-section, one-piece garment of claim 70, wherein the multi-layer padding in a portion or portions of the vest consists of only the first and third or outer and inner layers at or over openings, seams, breaks, slits, cuts or cut outs in the second, or middle layer of the multi-layer padding.

92. A multi-section, one-piece garment for protecting against impact upon a human torso when worn by an athlete during sporting activities, the multi-section, one-piece garment comprising:

a vest sized and shaped to be worn on a torso of an athlete, the vest comprising an anterior portion, a posterior portion, a pair of lateral portions and a shoulder portion, the vest having a multi-layered padding to protect the torso of the athlete including a chest, an abdomen, a pair of lateral regions and a shoulder area, the multi-layered padding having three layers, wherein the first, or outer layer and the third, or inner layer of the multi-layered padding sandwich, or are joined at a seam to provide a shell for, the second, or middle layer, the second layer being formed from a padding material for protecting against impact to the torso, the posterior portion of the vest being comprised primarily, if not totally of material that provides for the cooling of the underlying torso, the vest having an offset opening, the offset opening being located off set from the medial line of a human torso to protect the heart against impact, the vest having a fastening device or devices, the fastening device or devices being fastened to secure the vest about the torso.

93. The multi-section, one-piece garment of claim 92, wherein the shoulder portion having the multi-layered padding sized and shaped to provide protection to the shoulder area and permit unhindered movement of the arms and neck, the shoulder portion further having a pair of oversized apertures located at the lateral most regions for receiving the arms, each oversized aperture being sized and shaped to permit full movement of the arm.

94. The multi-section, one-piece garment of claim 93, wherein the shoulder portion having the multi-layered padding or a layer or layers thereof, being comprised of elastic material.

95. The multi-section, one-piece garment of claim 92, wherein the anterior portion and pair of lateral portions have the multi-layered padding sized and shaped to allow unhindered movement of the legs and to protect against impact to the chest, heart, spleen, abdomen and lateral regions.

96. The multi-section, one-piece garment of claim 92, wherein at least one adjustable securing belt-like device such as a belt, strap or drawstring is wrapped around the multi-layered padding, or partially thereof, on the first, or outer layer, the second, or middle layer, or a layer thereof, or the first and second layer alternately, of the vest to secure the vest about the torso, the adjustable securing belt-like device being inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

97. The multi-section, one-piece garment of claim 92, wherein the posterior portion contains at least one fastener or holder for securing a removable strip of fabric or flag.

98. The multi-section, one-piece garment of claim 92, wherein the superior regions of the anterior portion are shaped in a convex configuration, the convex configuration providing space for receiving breasts.

99. The multi-section, one-piece garment of claim 92, wherein the inferior-most regions of the pair of lateral portions are shaped in a concave configuration, the concave configuration providing space for receiving the hip.

100. The multi-section, one-piece garment of claim 92, wherein an overlap or flap extending or being located over the offset opening and sized and shaped to protect the region of the offset opening against impact and cover the area of the vest about the offset opening, the overlap or flap extending from or being attached to the vest and fastened across the offset opening by a fastening device or devices, securing the vest on the torso.

101. The multi-section, one-piece garment of claim 100, wherein the flap contains at least one fastener attached on its exterior surface and correspondingly on the exposed exterior surface of the vest to secure the flap in an open position on the vest.

102. The multi-section, one-piece garment of claim 100, wherein the superior region of the overlap or flap is shaped in a convex configuration, the convex configuration providing space for receiving breasts.

103. The multi-section, one-piece garment of claim 92, wherein at least one slot or opening located on the interior or exterior surface or the first or third layer of the multi-layered padding, or in the seam where the first and third layers are joined to form the shell, which may or may not have a fastening device or devices to secure it in a closed position, allows for the removal or insertion of the second layer, or a layer or layers, or a portion or portions, or a section or sections thereof, from the vest.

104. The multi-section, one-piece garment of claim 92, wherein the first and/or third layers of the multi-layered padding being formed from an air-permeable and/or wicking material to allow for the cooling of the underlying torso.

105. The multi-section, one-piece garment of claim 92, wherein the first layer and/or second layer and/or third layer of the multi-layered padding, or portions or sections thereof, is comprised of multiple layers.

106. The multi-section, one-piece garment of claim 92, wherein a protective pad or pads comprising rigid, semi-rigid or flexible material are affixed onto, and/or inserted into a pocket on, the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, of the anterior portion and sized and shaped to provide protection from impact to the heart and/or spleen, the protective pad or pads being removable and insertable by the wearer, with access to the interior of the shell provided via either the slot or opening that allows for the removal or insertion of the second, or middle layer of the multi-layer padding from the vest, or a separate slot or located opening on the interior or exterior surface of the shell, or in the seam where the first and third layers of the multi-layer padding are joined to form the shell, which may or may not be secured in a closed position by a fastening device or devices.

107. The multi-section, one-piece garment of claim 92, wherein the inferior-most region of the posterior portion contains a back strap fastener therein to connect to a front strap fastener located on the anterior portion by a strap therein to engage the posterior portion to the anterior portion.

108. The multi-section, one-piece garment of claim 95, wherein the pair of lateral portions have the multi-layered padding, or a layer or layers thereof, being comprised of elastic material.

109. The multi-section, one-piece garment of claim 92, wherein the lateral most edges of the second layer of the multi-layered padding in the anterior portion of the vest, or a layer thereof, extends over or overlaps the pair of lateral portions of the vest for the purpose of maintaining a second layer of the multi-layered padding between the first and third layers in the pair of lateral portions of the vest as the vest stretches horizontally to accommodate larger torso sizes.

110. The multi-section, one-piece garment of claim 93, wherein the shoulder portion, or a section or sections thereof, has the multi-layered padding consisting of only the outer layer and the inner layer to permit unhindered movement of the arms and neck.

111. The multi-section, one-piece garment of claim 95, wherein the lateral portions, or a section or sections thereof has the multi-layered padding consisting of only the outer layer and the inner layer to permit unhindered movement of the legs and torso and provide for the cooling of the underlying torso.

112. The multi-section, one-piece garment of claim 92, wherein the multi-layer padding in a portion or portions of the vest consists of only the first and third or outer and inner layers at or over openings, seams, breaks, slits, cuts or cut outs in the second, or middle layer of the multi-layer padding.

113. The multi-section, one-piece garment of claim 92, wherein the multi-layered padding, or a layer or layers thereof, is punctuated with a plurality of air holes to provide for the cooling of the underlying torso.

* * * * *